US006311979B1

(12) United States Patent
Andrews

(10) Patent No.: US 6,311,979 B1
(45) **Date of Patent: *Nov. 6, 2001**

(54) METHOD AND APPARATUS FOR PLAYING A PINOCHLE-POKER TYPE WAGERING GAME AT A GAMING TABLE AND ON VIDEO GAMING MACHINES

(76) Inventor: Douglas S. Andrews, 6168 Meadow View La., Las Vegas, NV (US) 89103

( * ) Notice: Subject to any disclaimer, the term of this patent is extended or adjusted under 35 U.S.C. 154(b) by 0 days.

This patent is subject to a terminal disclaimer.

(21) Appl. No.: 09/440,085

(22) Filed: Nov. 15, 1999

(51) Int. Cl.[7] ..... A63F 1/00
(52) U.S. Cl. ..... 273/292
(58) Field of Search ..... 273/292, 273, 273/274, 303, 304, 305, 306; 463/13, 12

(56) References Cited

U.S. PATENT DOCUMENTS

| | | | | |
|---|---|---|---|---|
| 5,019,973 | * | 5/1991 | Wilcox et al. | 364/412 |
| 5,382,025 | * | 1/1995 | Sklansky et al. | 273/292 |
| 5,653,444 | * | 8/1997 | Dahl | 273/274 |
| 5,762,340 | * | 6/1998 | Feola | 273/292 |
| 5,810,354 | * | 9/1998 | Banyai | 273/292 |
| 5,816,914 | * | 10/1998 | Wichinsky | 463/13 |
| 5,823,873 | * | 10/1998 | Moody | 463/13 |
| 5,845,907 | * | 12/1998 | Wells | 273/292 |
| 5,868,392 | * | 2/1999 | Kraft | 273/292 |
| 5,868,618 | * | 2/1999 | Netley et al. | 463/13 |
| 5,901,958 | * | 5/1999 | Andrews | 273/292 |
| 5,908,353 | * | 6/1999 | Andrews | 463/13 |
| 5,944,315 | * | 8/1999 | Mostashari | 273/292 |

OTHER PUBLICATIONS

Gibson, "Hoyle's Modern Encyclopedia of Card Games", 1974, pp. 174 and 259.*

* cited by examiner

*Primary Examiner*—Raleigh W. Chiu
(74) *Attorney, Agent, or Firm*—Philip D. Junkins

(57) ABSTRACT

A method of playing at a gaming table or on an electronic video gaming machine a player-versus-paytable five-card stud poker game utilizing the 20 royal cards and 4 number nine cards of the four card suits of a standard 52-card poker deck as a 24-card pinochle-poker deck of cards with player awards based upon predetermined amounts related to a paytable of winning five-card hands. Initially a "bet" wager is made by a player and from the pinochle-poker deck two cards are dealt face-down and three cards are dealt face-up to the view of the player. The player, after viewing the face-up cards, is permitted to stand on the "bet" wager or double or triple the "bet" wager after which the face-down cards are up-turned and may be used as community cards in the hand of the player. The player's hand is evaluated to determine whether or not such hand is a winning hand with respect to a paytable of winning five-card hands with a winning hand paid off in accordance with the paytable.

17 Claims, 2 Drawing Sheets

Figure 1:
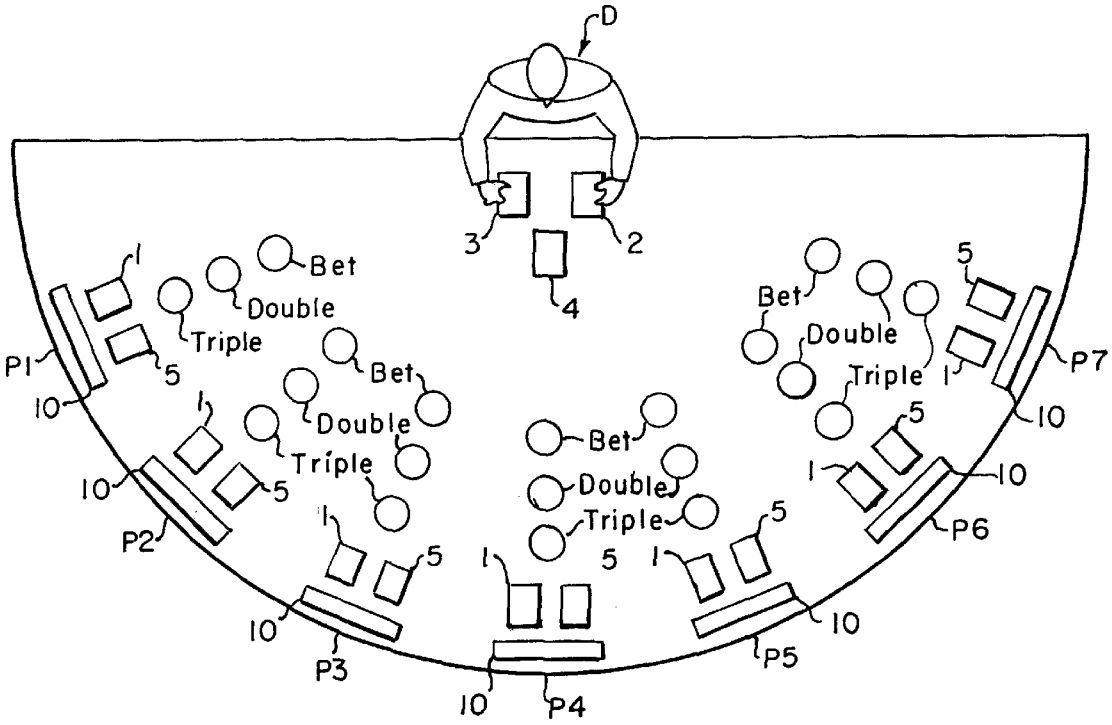

METHOD AND APPARATUS FOR PLAYING A PINOCHLE-POKER TYPE WAGERING GAME AT A GAMING TABLE AND ON VIDEO GAMING MACHINES

BACKGROUND OF THE INVENTION

1. Field of the Invention

The present invention relates to five-card stud poker games and, more particularly, to: multiple player five-card stud table poker games in which each player plays against the dealer (not against the other players) and in which each player places an initial "bet" wager before being dealt (face-down) a partial poker hand or a five-card poker hand; and single player five-card draw poker games played on video gaming devices.

In multiple player stud poker table games the dealer also deals to himself or herself a number of dealer's cards with at least several of such cards dealt face-up. Each player thereupon compares his or her cards with the dealer's face-up cards providing the player with opportunity to decide whether or not to surrender the hand (and the player's original "bet" wager) or to place an "additional" wager on the hand as dealt or in anticipation of receiving the remainder of a five-card poker hand or exchanging one or more of the original cards of a five-card hand with replacement dealer dealt cards.

In some "player-versus-dealer" five-card stud poker table games the dealer may add face-up cards in sequence to his or her partial hand with player "additional" wagering upon each addition of a card to the dealer's hand. Further, where the dealer's hand (as originally dealt) comprises five cards, the dealer may turn one or more cards face-up in sequence with player "additional" wagering upon each dealer card turn-up. In either of the foregoing (or other) variations of "player-versus-dealer" five-card stud poker games, the individual player may surrender his or her hand (with any and all wagers) after any wagering round. In such games each player having a higher value hand with respect to the dealer's hand wins the amount of his or her wagers from the dealer.

Where the dealer merely deals cards in turn to each player, with the players competing against one-another and not the dealer, a uniform pre-deal "ante" wager is usually made by each player and a post-deal "additional" wager ensues. Each player thereafter may in turn request substitute cards, i.e. draw cards, for his or her hand discarding the cards for which substitute cards are dealt. Thus, this form of poker is termed "draw poker" and further "additional" wagering ensues for one or more player-raise rounds. The highest value player hand wins the amount of all "ante" wagers and "additional" wagers (the "pot") from all of the players.

The gaming methods described hereinbefore may also be played on electrical or electro-mechanical video gaming devices provided with suitable controls for receiving single player input of game choices.

2. Description of Related Prior Art

Poker is one of the most exciting gambling games because it includes for each individual player a mix of skill, luck, and psychology. Throughout the world millions of players try their luck each year at the game of poker at card tables and on video poker machines in gaming rooms and casinos.

Five-card draw poker, as a table game, is typically played in two basic formats, i.e., between players or between individual players and a house dealer. Many players prefer a player-versus-player game because it involves the elements of inter-player skill and psychology, the latter element including a player's ability to bluff the strength of his or her hand versus the assumed strength of the hands of the other players. Many other players prefer to play a "stud" form of poker, at a standard gaming table, against a house dealer or against a paytable of hands because such game play tends to minimize the elements of skill and psychology with each player relying principally on luck.

Over the years a variety of stud poker table games have been proposed including: games using one standard deck of 52 cards; and games using card combinations of less than the 52 cards of a standard deck of cards. Recently the inventor of the present invention received the grant of U.S. Pat. No. 5,901,958, entitled "Method of Playing a Royal Card Stud Poker Game at a Casino Gaming Table", wherein the claimed stud poker game utilizes the 20 royal cards of a standard 52-card deck of cards. The present inventor has also received the grant of U.S. Pat. No. 5,908,353, entitled "Method and Apparatus for Playing Royal Card Stud Poker and Royal Card Draw Poker Games", wherein the claimed method and apparatus also utilizes the 20 royal cards of a standard 52-card deck of cards.

There remains a need in the gaming room and casino businesses for multiple player stud poker type games which can be played at a standard gaming table, and single player stud poker games which can be played on electronic video poker gaming devices, with such games providing an appropriate mix of the elements of player skill, psychology and luck along with a speed-up of game play time and the excitement of involving royal card hands.

OBJECTS AND SUMMARY OF THE INVENTION

The present invention comprises a method and apparatus for playing a five-card stud pinochle-poker game limited to the use of a set of the pinochle cards (twenty-four cards) available in a single standard 52 card deck, i.e., 4 each of the deck's aces, kings, queens, jacks, tens and nines. Thus, the unique present game format is most suitable for: a player-versus-paytable game at the gaming tables commonly available in public and private gaming rooms and casinos; and a single player game on electronic video game machines available in gaming rooms and casinos.

In a first preferred embodiment of the game played at a game table with up to seven players, the method comprises the steps of:

a) accepting from each player an initial "bet" wager placed in front of the player on the game table at his or her play position at the table;

b) dealing in sequence to each player one card face-down from the deck of 24 cards (all of the 9s, 10s, jacks, queens, kings and aces of a standard deck) and dealing two community cards face-up and one community card face-down to a dealer position on the game table;

c) permitting each player, in sequence, after viewing the two face-up cards at the dealer position and his or her face-down card, to either stand on the "bet" wager or double or triple the "bet" wager by placing a "first additional" like wager or "first and second additional" like wagers in front of his or her play position;

d) dealing in sequence to each player a second card face-down from the deck of 24 cards and turning up the face-down community card at the dealer position on the table;

e) permitting each player, in sequence, to turn up his or her two face-down cards to complete, with the three face-up cards at the dealer position, a five-card stud poker hand; and f) evaluating each of the player's completed hands by the dealer to determine whether or not such hand or hands comprises a winning hand in accordance with the paytable for the game followed by pay-off of the winning hand or hands.

For the above preferred embodiment of the five-card stud pinochle-poker game of the invention the paytable may comprise:

i) loss of a player's wagers to the dealer for a hand displaying two pairs or less of cards with no pair comprised of kings or aces;

ii) an even payoff (push) of the player's wagers for a hand displaying two pairs with at least one of the pairs comprised of a pair of kings or aces;

iii) a 2 to 1 payoff of the player's wagers for a hand displaying three of a kind;

iv) a 4 to 1 payoff of the player's wagers for a hand displaying a five card straight;

v) a 6 to 1 payoff of the player's wagers for a hand displaying a flush of 5 cards of the same (like) suit;

vi) a 7 to 1 payoff of the player's wagers for a hand displaying a full house of cards;

vii) a 20 to 1 payoff of the player's wagers for a hand displaying four of a kind of cards;

viii) a 150 to 1 payoff of the player's wagers for a hand displaying a straight flush of cards; and ix) a 300 to 1 payoff of the player's wagers for a hand displaying a royal flush of cards.

It is to be noted that there would be no differentiation of payoff odds for any four of a kind hands and that the only form of straight flush other than a royal flush of cards comprises the 9 through king cards of a single suit of cards. Other variations of the basic five-card stud pinochle-poker game of the first preferred game method of the invention may include the addition to the twenty-four cards of the game deck of a duce as a wild card, a joker as a wild card or any other low card of the standard deck (Below a 9), in which case the game win odds of the paytable are appropriately diminished.

In a second preferred embodiment of the game for up to seven players, the method comprises the steps of:

a) accepting from each player an initial "bet" wager placed in front of the player on the game table at his or her play position at the table;

b) dealing in sequence to each player one card face-down from the deck of 24 cards (all of the 9s, 10s, jacks, queens, kings and aces of a standard deck) and dealing two community cards face-up and one community card face-down to a dealer position on the table;

c) permitting each player, in sequence, after viewing the face-up cards at the dealer position and his or her face-down card, to either stand on the "bet" wager or double the "bet" wager by placing a "first additional" wager in front of his or her play position;

d) dealing in sequence to each player a second card face-down;

e) permitting each player, in sequence, after viewing his or her two face-down cards, to either stand on previous "bet" wagers or triple the "bet" wagers by placing a "second additional" wager in front of his or her play position;

f) turning up the face-down community card at the dealer position on the table;

g) permitting each player, in sequence, to turn up his or her two face-down cards to complete, with the three face-up cards at the dealer position, a five-card stud poker hand; and h) evaluating each of the player's completed hands by the dealer to determine whether or not such hand or hands comprises a winning hand in accordance with the paytable for the game followed by pay-off of the winning hand or hands.

For the above second preferred embodiment of the five-card stud pinochle-poker game of the invention the paytable may comprise:

i) loss of a player's wagers to the dealer for a hand displaying two pairs or less of cards;

ii) an even payoff (push) of the player's wagers for a hand displaying three of a kind cards;

iii) a 3 to one payoff of the player's wagers for a hand displaying a five card straight;

iv) a 6 to one payoff of the player's wagers for a hand displaying a full house of cards;

v) a 15 to one payoff of the player's wagers for a hand displaying four of a kind cards;

vi) a 40 to one payoff of the player's wagers for a hand displaying a straight flush of cards; and vii) a 100 to one payoff of the player's wagers for a hand displaying a royal flush of cards.

It is to be noted that there would be no differentiation of payoff odds for any four of a kind hands and that the only form of straight flush other than a royal flush of cards comprises the 9 through king cards of a single suit of cards. Other variations of the basic five-card stud pinochle-poker game method of the invention may include the addition to the twenty-four cards of the game deck of a duce as a wild card, a joker as a wild card or any other low card of the standard deck (below a 9), in which case the game win odds are appropriately diminished.

The preferred gaming methods of the invention for playing a five-card stud pinochle-poker game as described above may also be played on electrical or electro-mechanical video gaming devices provided with suitable controls for receiving single player input of game wagering and card selection choices.

It is a principal object of the present invention to provide a player-versus-paytable five-card stud pinochle-poker game involving only the pinochle cards of a single standard 52 card deck.

It is a further object of the invention to provide a player-versus-paytable five-card stud pinochle-poker game for up to seven players involving the 24 pinochle cards forming the four suits of a standard 52 card deck and which involves an appropriate mix of the elements of player skill, psychology and luck with a speed-up of game play time and the excitement of obtaining a straight flush or a royal flush as high payoff hands.

It is a still further object of the invention to provide a video gaming machine apparatus which displays in a five-card stud poker format the pinochle cards of the four suits of a single standard 52 card deck and which encourages a high amount of individual player interest while maintaining acceptable payback percentages.

It is yet another object of the invention to provide methodology and apparatus for playing a player-versus-paytable pinochle-poker type five-card stud wagering game wherein the player or players may have the opportunity of doubling or doubling and tripling the player's original wager bet and wherein the game encourages a high amount of individual player interest while maintaining acceptable payback percentages.

BRIEF DESCRIPTION OF THE DRAWING FIGURES

Figure 2:
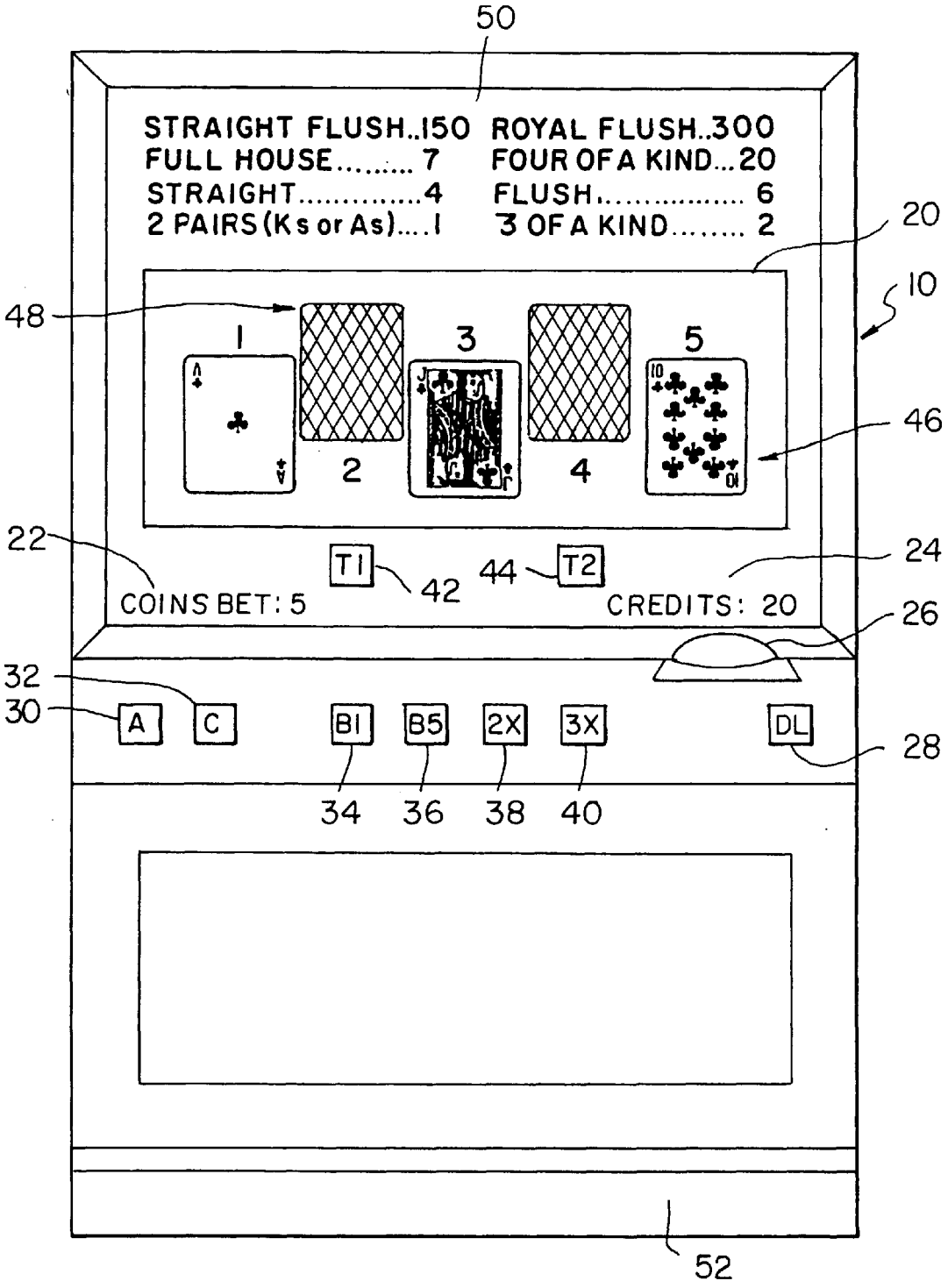

The objects and features of the present invention, which are believed to be novel, are set forth with particularity in the appended claims. The present player-versus-paytable five-card stud pinochle-poker game of the invention, both as to its organization, manner of play and apparatus, together with further objects and advantages, may best be understood by reference to the following description, taken in connection with the accompanying drawing figures in which:

FIG. 1 shows a top plan view of a gaming table for playing the preferred versions of the five-card stud pinochle-poker game methods of the present invention, by up to seven players, the variety of the games of the invention being played within the method termed generally herein "five-card stud pinochle-poker"; and FIG. 2 shows in a front elevation view an electronic video stud poker gaming machine of the present invention and upon which the five-card stud pinochle-poker games of the invention can be played by an individual player.

DETAILED DESCRIPTIONS OF PREFERRED EMBODIMENTS

The following description is provided to enable any person skilled in the gaming art to organize and use the invention and sets forth the best modes contemplated for carrying out the game methods of the invention. Various modifications of the methods, however, will become readily apparent to those skilled in the gaming art, since the basic principles of the present game methods will have been specifically provided hereinafter as unique methods of playing a player-versus-dealer five-card stud penochle-poker game.

1. Description of a First Preferred Embodiment of the "Five-Card Stud Pinochle-Poker" Game of the Invention.

The first preferred version of the game method of the present invention uses the 20 royal flush cards (4 10s, 4 jacks, 4 queens, 4 kings and 4 aces) and 4 nines from the four card suits of a standard 52-card poker deck. These 24 cards are shuffled and formed into a deck of cards hereinafter referred to as the "pinochle-poker deck of cards." The game method of the first preferred version is designed to serve up to seven players. Drawing FIG. 1 shows a common semi-circular gaming table T arranged with seven player positions P1, P2, P3, P4, P5, P6 and P7 and a game card dealer D positioned across the table facing the players. In front of each player there is located a sequence of three wagering circles labeled "bet", "double" and "triple" within which each player may place his or her initial "bet" wager and optional first and second "addition-al" wagers.

Drawing FIG. 1 also shows two cards numbered 1 and 5 at each player position on the gaming table and three cards numbered 2, 3 and 4 at the dealer position on the gaming table. Cards numbered 1 are dealt in sequence face-down to the player positions P1 through P7 and cards 2, 3 and 4 are dealt as community cards to the dealer position with cards 2 and 3 being dealt face-up and card 4 being dealt face-down, all from the shuffled pinochle-poker deck of cards. Poker chip or coin trays 10 may also be provided at each of the player positions on the game table T.

Before dealing any cards from the pinochle-poker deck of cards the players at the gaming table place their individual initial wager in the "bet" wagering circle in front of their respective player position. Thereafter, the game cards numbers 1 through 4 are dealt by the dealer as indicated hereinbefore. Following the distribution of pinochle-poker cards as indicated, the players individually and privately look at and evaluate their respective initial three card hand comprised of card 1 at their respective player position and the two face-up cards 2 and 3 at the dealer position 10. Each player is then permitted, in sequence, to either stand pat on the "bet" wager, or double or triple the "bet" wager by placing a first equivalent "additional" wager in the "double" circle on the gaming table in front of his or her player position at the table or by placing first and second equivalent "additional" wagers in the "double" circle and in the "triple" circle on the gaming table in front of his or her player position at the table.

Following the placing of all first or first and second "additional" wagers by the game players, the dealer deals a second face-down card, card number 5, to each player and turns up the face-down community card number 4 for review by each player and visual incorporation and evaluation of same as a fifth card of the player's hand. The players thereupon upturn their face-down cards for evaluation of their completed hands by the dealer to determine whether or not such hands comprise winning five-card stud pinochle-poker hands in accordance with the paytable applicable to the game.

For the five-card stud pinochle-poker game played as described above, the paytable may for player hands comprise:

- Two pairs or less with no pair comprised of a pair of kings or aces—loss of a player's wagers
- Two pairs including a pair of kings and/or a pair of aces—an even payoff (push) of a player's wagers
- Three of a kind—2 to 1 payoff of a player's wagers
- Five card straight—4 to 1 payoff of a player's wagers
- Flush of 5 cards of same suit—6 to 1 payoff of a player's wagers
- Full house—7 to 1 payoff of a player's wagers
- Four of a kind—20 to 1 payoff of a player's wagers
- Straight flush (cards 9 to king of a single suit)—150 to 1 payoff of a player's wagers
- Royal flush—300 to 1 payoff of a player's wagers It is to be noted that there would be no differentiation of payoff odds for any four of a kind hands.

2. Description of a Second Preferred Embodiment of the "Five-Card Stud Pinochle-Poker" Game of the Invention.

The second preferred version of the game method of the present invention also uses the 20 royal flush cards and 4 nines from the four card suits of a standard 52-card poker deck. These 24 cards are shuffled and formed into a "pinochle-poker deck of cards" as is the case with the first preferred embodiment of the five-card stud pinochle-poker method of the invention. The game method of the second preferred version is also designed to serve up to seven game players. In this game version, in front of each player, there is also located a sequence of three wagering circles labeled "bet", "double" and "triple" within which each player may place his or her initial "bet" wager and optional first and second "additional" wagers.

Cards numbered 1 are dealt in sequence face-down to the player positions P1 through P7 and cards 2, 3 and 4 are dealt as community cards to the dealer position with cards 2 and 3 being dealt face-down and card 4 being dealt face-up, all from a shuffled pinochle-poker deck of cards. Before dealing any cards from the pinochle-poker deck of cards the players at the gaming table place their individual initial wager in the "bet" wagering circle in front of their respective player position. Thereafter, cards numbered 5 are dealt in sequence face-down to the player positions. Following the distribution of pinochle-poker cards as indicated, the players individually and privately look at and evaluate their respective initial three card hand comprised of cards 1 and 5 at their respective player position and the single face-up card 4 at the dealer position 10. The players are then permitted, in sequence, to either stand pat on the "bet" wager, or double the "bet" wager by placing a first equivalent "additional" wager in the "double" circle on the gaming table in front of his or her player position at the table.

Following the placing of all first "additional" wagers by the game players, the dealer displays (by upturn) the face-down card 2 or 3 at the dealer position as a second face-up community card for review and evaluation by each player and visual incorporation as a forth card of each player's hand. The players are then permitted, in sequence, to either stand pat on his or her present wagers, or triple his or her "bet" wager by placing a second equivalent "additional" wager in the "triple" circle on the gaming table in front of his or her player position at the table.

Following the placing of all second "additional" wagers by the game players, the dealer displays (by upturn) the remaining face-down card 3 or 2 at the dealer position as a third face-up community card for review and evaluation by each player and visual incorporation as a fifth card to complete each player's hand. The players thereupon upturn their face-down cards for evaluation of their completed hands by the dealer to determine whether or not such hands comprise winning five-card stud pinochle-poker hands in accordance with the paytable applicable to the game. The paytable as set forth with respect to the Second Preferred Embodiment of the invention may for player hands comprise:

Two pairs or less—loss of a player's wagers

Three of a kind—even payoff (push) of a player's wagers

Five card straight—3 to 1 payoff of a player's wagers

Full house—6 to 1 payoff of a player's wagers

Four of a kind—15 to 1 payoff of a player's wagers

Straight flush (cards 9 to king of a single suit)—40 to 1 payoff of a player's wagers Royal flush—100 to 1 payoff of a player's wagers It is to be noted that there would be no differentiation of payoff odds for any four of a kind hands.

Variations in the paytable of the foregoing preferred embodiments of the invention may occur where a wild card (duce, joker or other card of denomination less than 9) is incorporated in the "pinochle-poker deck of cards". Those skilled in the gaming art will appreciate that various adaptations and modifications of the above described preferred method embodiments of the present invention can be configured without departing from the scope and spirit of the invention.

3. Description of a Preferred Embodiment of the "Five-Card Stud Pinochle-Poker" Game of the Invention when incorporated in an electro-mechanical video gaming machine.

The preferred embodiment of the game method of the invention, as applied to video gaming machines, uses an electronic card deck comprised of the 20 royal flush cards (4 10s, 4 jacks, 4 queens, 4 kings and 4 aces) and the 4 9s from the four card suits of a standard 52 card poker deck. These 24 cards are electronically shuffled and formed by the video apparatus of the invention into a deck of cards referred to as the "pinochle-poker deck of cards." Drawing FIG. 2 shows, in a front elevation view, an electronic video stud poker gaming machine 10 upon which the five-card stud pinochle-poker game methodology of the invention can be played by an individual player to attain a winning poker hand versus the paytable established for the game.

The FIG. 2 electronic gaming machine apparatus 10 of the invention includes a video display screen 20 upon which there is displayed a player's initial three cards of a stud poker hand upon game initiation via the deposit of the player's "bet" wager of coins or tokens or charge of coins or tokens against the player's machine bank of coins or tokens. For each stud poker game the initial hand of cards comprises three cards displayed by random electronic card selection via the gaming apparatus of the invention from the 24 card "pinochle-poker deck of cards." An LED display 22 shows the number of coins or tokens wagered by the player. Another LED display 24 shows the number of coin or token credits remaining in the player's machine bank. A single coin or token entry slot 26 is provided for the reception of the player's initial "bet" wager and follow-up wagering sums. Game initiation is accomplished by the deposit in the entry slot 26 of a maximum number of coins or tokens (typically 5), by the deposit in the entry slot 26 of less than the maximum number of coins or tokens followed by actuation of the deal control button 28, by actuation (or repeated actuation) of the bet one "B1" control 34 followed by actuation of the deal control button 28, or by actuation of the maximum bet "B5" control button 36 which automatically withdraws maximum "bet" coins or tokens from the player's machine bank of coins or tokens.

The example of an initial stud poker hand as shown in FIG. 2 is displayed in sequence on the video display screen 20 as a partial hand 46 of face-up pinochle-poker cards 1, 3 and 5, i.e., ace of clubs (card 1), jack of clubs (card 3) and 10 of clubs (card 5). Two face-down cards 48 are dealt in card positions 2 and 4. Where the game methodology comprises the game method as described in the Preferred Embodiment Method 2 above, following the deal and display of the initial partial hand 46, the player has the option choice of standing on or doubling his or her initial "bet" wager based the player's view of the probability of obtaining a winning hand by the turn-up of favorable cards comprising the first and second face-down cards, i.e., cards 2 and 4 (respectively) of the face-down cards 48.

Where the video stud poker player elects to stand on his or her original "bet" wager, the deal control button 28 is actuated and the gaming machine 10 turns cards 2 and 4 face-up to complete the five-card stud pinochle-poker hand followed by machine evaluation of the hand with respect to the paytable 50 of winning hands for the stud pinochle-poker video game of the machine 10. As a result of such machine evaluation, pay-off is made by the machine to the player's machine credit bank of an appropriate amount of coins or tokens for a winning hand according to the paytable 50 of winning hands as related to the number of coins or tokens wagered by the player.

Where the video stud pinochle-poker player elects to double his or her original "bet" wager the player actuates the double bet "2×" button 38 whereupon the machine registers in LED display 22 the double bet amount and the machine debits the player's machine credit bank the amount of the double bet and charges such debit amount against the player's machine credit bank as shown in LED display 24. The player then actuates the "T1" card turn button 42 whereupon the video machine 10 turns up for display the face-down card 2 and the player again evaluates the then four face-up cards of the hand and assesses the probability of obtaining a winning hand when the face-down card 4 is turned up. If the player elects to triple his or her original "bet" wager the player actuates the triple bet "3×" button 40 whereupon the machine registers in LED display 22 the triple bet amount and the machine debits the player's machine credit bank the amount of the triple bet and charges such debit amount against the player's machine credit bank as shown in LED display 24.

If the video stud poker player elects to not triple his or her "bet" wager the "T2" card turner button 44 is actuated and the machine thereupon turns up for display the face-down card 4 to complete the stud poker hand followed by machine evaluation of the hand with respect to the paytable 50 of winning hands for the stud pinochle-poker video game of the machine 10 and payoff of an appropriate amount of coins or tokens for a winning hand according to the paytable as related to the double bet wagered by the player. Where the player has elected to triple his or her original "bet" wager, upon actuation of the triple bet "3×" button 40 the electronic stud pinochle-poker video machine 10 of the invention up the face-down card 4 for display. The machine 10 thereupon evaluates the completed hand with respect to the paytable 50 of winning hands and the machine pays off an appropriate amount of coins or tokens for a winning hand according to the paytable as related to the total number of coins or tokens wagered by the player.

The video stud pinochle-poker machine of the invention, as shown in FIG. 2, also includes and attendant "A" call button 30 and a cashout "C" button 32. The actuation of the cashout button 32 causes gaming coins or tokens to be deposited from a hopper inside the machine (not shown) into a 52.

As previously indicated, for the five-card stud pinochle-poker game versions and apparatus of the invention described hereinbefore, the paytables may vary depending upon the exact version of the game method played on a game table or via a video game machine. Variations in the paytables may also occur where a wild card is incorporated in the 24 card pinochle-poker deck. Other variations in the game methods of the invention may relate to the manner in which the cards are dealt and positioned with respect to a game table or to the manner in which the cards are electronically dealt and positioned with respect to the video gaming machines of the invention.

Those skilled in the gaming art will appreciate that various adaptations and modifications of the above described preferred method and apparatus embodiments of the present invention can be configured without departing from the scope and spirit of the invention. Therefore, it is to be understood that, within the scope of the appended claims, the invention may be practiced other than as specifically described herein.

What is claimed is:

1. A method of playing a player-versus-paytable five-card stud poker game for up to seven players utilizing the 20 royal cards and 4 number nine cards of the four card suits of a standard 52-card poker deck as a 24-card pinochle-poker deck of cards with player awards based upon predetermined payoff amounts related to a paytable of winning five-card hands, said method comprising:

a) accepting from a player an initial "bet" wager;

b) dealing up to two cards as player cards and dealing up to three cards as community cards from said pinochle-poker deck, at least one of said community cards being dealt face-up and at least one of said community cards being dealt face-down;

c) permitting the player after viewing at least one of his or her dealt cards and the at least one face-up community card, to either stand on the "bet" wager and dealt cards, double the "bet" wager, or triple the "bet" wager;

d) displaying all of said player cards and community cards for review by the player to be used as cards to complete the player's hand; and e) evaluating the player's completed hand to determine whether or not said hand comprises a winning hand in accordance with said paytable of winning five-card hands and paying off to the player an award according to said paytable.

2. A method of playing at a gaming table a player-versus-paytable five-card stud poker game for up to seven players utilizing the 20 royal cards and 4 number nine cards of the four card suits of a standard 52-card poker deck as a 24 -card pinochle-poker deck of cards with player awards based upon predetermined amounts related to a paytable of winning five-card hands, said method comprising:

a) accepting from each player at a player position at said gaming table an initial "bet" wager;

b) dealing in sequence one card face-down to each of the occupied player positions on said gaming table in rotation from said pinochle-poker deck of cards and dealing three community cards from said pinochle-poker deck to a dealer position on said gaming table, two of said dealer position cards being dealt face-up and one of said dealer position cards being dealt face-down;

c) permitting each player in the game, in sequence, after viewing his or her dealt card and the face-up cards at said dealer position, to either stand on the "bet" wager or double or triple the "bet" wager by placing a "first additional" like wager or "first and second additional" like wagers in front of his or her play position;

d) dealing in sequence a second card face-down to each of the occupied player positions on said gaming table in rotation from said pinochle-poker deck of cards and turning up the face-down community card at the dealer position on the table;

e) permitting each player, in sequence, to turn up his or her two face-down cards to complete, with the three face-up community cards at the dealer position, a five-card stud poker hand; and f) evaluating each of the player's completed hands by the dealer to determine whether or not such hands comprise winning hands in accordance with said paytable of winning hands and paying off said winning hands.

3. The method of claim 2 wherein the 24-card pinochle-poker deck of cards utilized in said five-card stud poker game has added thereto a duce card as a wild card for use by a player in his or her hand comprised of two dealt cards or as may be included in his or her hand as a community card at the dealer position.

4. The method of claim 2 wherein the 24-card pinochle-poker deck of cards utilized in said five-card stud poker game has added thereto a joker card as a wild card for use by a player in his or her hand comprised of the two dealt cards or as may be included in his or her hand as a community card at the dealer position.

5. A method of playing at a gaming table a player-versus-paytable five-card stud poker game for up to seven players utilizing the 20 royal cards and 4 number nine cards of the four card suits of a standard 52-card poker deck as a 24-card pinochle-poker deck of cards with player awards based upon predetermined amounts related to a paytable of winning five-card hands, said method comprising:

a) accepting from each player at a player position at said gaming table an initial "bet" wager;

b) dealing in sequence up to two cards face-down to each of the occupied player positions on said gaming table in rotation from said pinochle-poker deck of cards and dealing three cards as community cards from said pinochle-poker deck to a dealer position on said gaming table, at least one of said dealer position cards being dealt face-up and at least one of said dealer position cards being dealt face-down;

c) permitting each player, in sequence, after viewing his or her dealt cards, to either stand on the "bet" wager and dealt cards or double the "bet" wager by placing a first equivalent "additional" wager in front of his or her player position;

d) displaying the at least one face-down card at the dealer position as an upturned face-up community card for review by each player to be used as a card of the player's hand;

e) permitting each player in the game, in sequence, after viewing said at least one upturned face-up community card, to either stand on his or her present wagers, or triple his or her "bet" wager by placing a second equivalent "additional" wager in front of his or her player position;

f) displaying the remaining face-down card at the dealer position as a face-up community card for review by each player to be used as cards to complete the player's hand;

g) displaying the face-down cards at the player positions; and h) evaluating each of the player's completed hands to determine whether or not said hands comprise winning hands in accordance with said paytable of winning five-card hands and paying off said winning hands.

6. The method of claim 5 wherein the 24-card pinochle-poker deck of cards utilized in said five-card stud poker game has added thereto a duce card as a wild card for use by a player in his or her hand comprised of up to two dealt cards and as may be included in his or her hand as a community card at the dealer position.

7. The method of claim 5 wherein the 24-card pinochle-poker deck of cards utilized in said five-card stud poker game has added thereto a joker card as a wild card for use by a player in his or her hand comprised of up to two dealt cards and as may be included in his or her hand as a community card at the dealer position.

8. The method of claim 5 wherein said five-card stud poker game is limited to up to seven players and each player is dealt in rotation from said pinochle-poker deck of cards two cards face-down and three cards from said deck are dealt to the dealer position with one of said cards at the dealer position being dealt face-up.

9. The method of claim 5 wherein said five-card stud poker game is limited to up to seven players and each player is dealt in rotation from said pinochle-poker deck of cards two cards face-down and three cards from said deck are dealt to the dealer position with two of said cards at the dealer position being dealt face-up.

10. A method of playing at a gaming table a player-versus-paytable five-card stud poker game for up to seven players utilizing the 20 royal cards and 4 number nine cards of the four card suits of a standard 52-card poker deck as a 24-card pinochle-poker deck of cards with player awards based upon predetermined amounts related to a paytable of winning five-card hands, said method comprising:

a) accepting from each player at a player position at said gaming table an initial "bet" wager;

b) dealing in sequence one card face-down to each of the occupied player positions on said gaming table in rotation from said pinochle-poker deck of cards and dealing three cards as community cards from said pinochle-poker deck to a dealer position on said gaming table, two of said dealer position cards being dealt face-up and one of said dealer position cards being dealt face-down;

c) permitting each player in the game, in sequence, after viewing his or her dealt card and the face-up cards at said dealer position, to either stand on the "bet" wager or double the "bet" wager by placing a first equivalent "additional" wager in front of his or her player position;

d) dealing in sequence a second card face-down to each of the occupied player positions on said gaming table in rotation from said pinochle-poker deck of cards;

e) permitting each player in the game, in sequence, after viewing said second card, to either stand on his or her wagers, or triple his or her "bet" wager by placing a second equivalent "additional" wager in front of his or her player position;

f) displaying the face-down card at the dealer position as a face-up community card for review by each player to be used as a card to complete the player's hand; and g) evaluating each of the player's completed hands to determine whether or not said hands comprise winning hands in accordance with said paytable of winning five-card hands and paying off said winning hands.

11. The method of claim 10 wherein the 24-card pinochle-poker deck of cards utilized in said five-card stud poker game has added thereto a duce card as a wild card for use by a player in his or her hand comprised of two dealt cards or as may be included in his or her hand as a community card at the dealer position.

12. The method of claim 10 wherein the 24-card pinochle-poker deck of cards utilized in said five-card stud poker game has added thereto a joker card as a wild card for use by a player in his or her hand comprised of the two dealt cards or as may be included in his or her hand as a community card at the dealer position.

13. A method of playing at a gaming table a player-versus-paytable five-card stud poker game for up to seven players utilizing the 20 royal cards and 4 number nine cards of the four card suits of a standard 52-card poker deck as a 24-card pinochle-poker deck of cards with player awards based upon predetermined amounts related to a paytable of winning five-card hands, said method comprising:

a) accepting from each player at a player position at said gaming table an initial "bet" wager;

b) dealing in sequence two cards face-down to each of the occupied player positions on said gaming table in rotation from said pinochle-poker deck of cards and dealing three cards from said pinochle-poker deck to a dealer position on said gaming table, one of said dealer position cards being dealt face-up and two of said dealer position cards being dealt face-up as a first community card to be used as a card of the player's hand;

c) permitting each player, in sequence, after viewing his or her two dealt cards and said face-up card at said dealer position, to either stand on the "bet" wager or double the "bet" wager by placing a first equivalent "additional" wager in front of his or her player position on said gaming table;

d) displaying a first face-down card at the dealer position as a second face-up community card for review by each player to be used as a card of the player's hand;

e) permitting each player in the game, in sequence, after viewing said second face-up community card, to either stand on his or her present wagers, or triple his or her "bet" wager by placing a second equivalent "additional" wager in front of his or her player position on said gaming table;

f) displaying the second face-down card at the dealer position as a third face-up community card for review by each player to be used as a card to complete the player's hand; and g) evaluating each of the remaining player's completed hands to determine whether or not said hands comprise winning hands in accordance with said paytable of winning five-card hands and paying of said winning hands.

14. The method of claim 13 wherein the 24 card pinochle-poker deck of cards utilized in said five-card stud poker game has added thereto a duce as a wild card for use by a player in his or her hand comprised of the two dealt cards and as may be included in his or her hand as a community card at the dealer position.

15. The method of claim 13 wherein the 24 card pinochle-poker deck of cards utilized in said five-card stud poker game has added thereto a joker card as a wild card for use by a player in his or her hand comprised of the two dealt cards and as may be included in his or her hand as a community card at the dealer position.

16. Apparatus for playing a player-versus-paytable five-card stud poker game on an electronic video gaming machine utilizing the 20 royal cards and 4 number nine cards of the four card suits of a standard 52-card poker deck as a pinochle-poker deck of cards with player pay-off awards based upon predetermined amounts related to a paytable of winning five-card hands, said apparatus comprising:

a) means for accepting from a game player an initial "bet" wager;

b) means for displaying to the player on a video screen of said gaming machine a five-card poker hand from said pinochle-poker deck of cards with two cards of said hand dealt face-down and out of view to said player and with the other cards of said hand dealt face-up and to the view of said player;

c) wager means activated by the player, after viewing his or her face-up dealt cards, to either stand on said initial "bet" wager or to double or triple said initial "bet" wager;

d) card manipulation means activated by the player to turn up and display on said video screen said face-down cards to complete a five-card stud poker hand;

e) means for evaluating the player's final five-card stud poker hand to determine whether or not said final hand comprises a winning hand in accordance with said paytable of winning five-card hands; and f) means for awarding to the player a predetermined amount based upon the value of said final five-card stud poker hand with respect to said paytable.

17. The apparatus of claim 16 for playing a player-versus-paytable five-card stud poker game wherein the means for accepting from a game player an initial "bet" wager includes means for wagering at least one coin or token to activate said gaming machine.

* * * * *